US008453422B2

(12) United States Patent
Michels

(10) Patent No.: US 8,453,422 B2
(45) Date of Patent: Jun. 4, 2013

(54) METHOD OF AND APPARATUS FOR WRAPPING A STACK OF OBJECTS WITH A FILM

(75) Inventor: Frank Rolf Michels, Kleve (DE)

(73) Assignee: MSK-Verpackungs-Systeme GmbH, Kleve (DE)

( * ) Notice: Subject to any disclaimer, the term of this patent is extended or adjusted under 35 U.S.C. 154(b) by 386 days.

(21) Appl. No.: 12/973,290

(22) Filed: Dec. 20, 2010

(65) Prior Publication Data

US 2011/0146209 A1 Jun. 23, 2011

(30) Foreign Application Priority Data

Dec. 21, 2009 (EP) ..... 09015790

(51) Int. Cl.
*B65B 9/13* (2006.01)
*B65B 9/14* (2006.01)
*B65B 41/16* (2006.01)

(52) U.S. Cl.
USPC ..... 53/459; 53/168; 53/567; 53/389.4

(58) Field of Classification Search
CPC .... B65B 9/14; B65B 9/135; B65B 9/13; B65B 41/16
USPC ..... 53/441, 459, 168, 556, 567, 576, 53/389.4
IPC ..... B65B 9/13, 9/14, 41/16
See application file for complete search history.

(56) References Cited

U.S. PATENT DOCUMENTS

| | | | | |
|---|---|---|---|---|
| 3,072,354 | A * | 1/1963 | Giles et al. | 242/554.4 |
| 3,738,079 | A * | 6/1973 | Rudman et al. | 53/567 |
| 3,852,937 | A * | 12/1974 | Bitsura et al. | 53/442 |
| 3,897,674 | A | 8/1975 | Higgins | |
| 4,541,221 | A * | 9/1985 | Seragnoli | 53/389.4 |
| 6,381,929 | B1 | 5/2002 | Chen | |
| 7,210,278 | B2 * | 5/2007 | Chiu Chen | 53/567 |

FOREIGN PATENT DOCUMENTS

| | | | | |
|---|---|---|---|---|
| DE | 19954370 | A1 * | 5/2001 | |
| DE | 60020468 | T2 | 6/2006 | |
| EP | 294321 | A2 * | 12/1988 | 53/389.4 |
| EP | 429135 | A1 * | 5/1991 | |
| EP | 1086894 | A2 * | 3/2001 | |

* cited by examiner

*Primary Examiner* — Stephen F Gerrity
(74) *Attorney, Agent, or Firm* — Andrew Wilford

(57) ABSTRACT

An apparatus for wrapping a stack of objects with a film has first and second supplies of films and a pull-down device shiftable vertically along the stack of objects. A film-feed head has a drive roller rotatable about an axis in the film feed head and first and second pairs of counterrollers angularly offset from each other relative to the drive-roller axis. The drive roller and the pairs of counterrollers are relatively shiftable between end positions in each of which one of the pairs is spaced from the drive roller and the other pair is engaged with the drive roller. The first and second films pass between the respective first and second pairs and the drive roller. An actuator can shift the first and the second pairs of rollers relative the drive roller for pinching the films against the drive roller and, on rotation of the drive roller.

17 Claims, 3 Drawing Sheets

METHOD OF AND APPARATUS FOR WRAPPING A STACK OF OBJECTS WITH A FILM

FIELD OF THE INVENTION

The present invention relates to wrapping a stack of objects with a film. More particularly this invention concerns a production machine used with palletized freight.

BACKGROUND OF THE INVENTION

A typical machine for wrapping a stack of objects with a film has having a film feed head and a drawing/pull-down device. Film within the scope of this invention refers in particular to a plastic film and preferably an elastic plastic film. The stack of objects may consist of stacked goods such as boxes or the like. In addition, the stack of objects may also be appliances, for example, refrigerators. The stack of objects is advantageously held on a pallet.

An apparatus of this type known from practice in various embodiments. This apparatus has the disadvantage that complex conversion operations are necessary when packaging is to be performed with films of different formats or with different types of film in succession.

On the other hand, the object of the invention is to provide an apparatus of the type described above with which the disadvantage explained above can be effectively avoided. Another object of the invention is to provide a corresponding method.

OBJECTS OF THE INVENTION

It is therefore an object of the present invention to provide an improved method of and apparatus for wrapping a package stack with a film.

Another object is the provision of such an improved method of and apparatus for wrapping a package stack with a film that overcomes the above-given disadvantages.

SUMMARY OF THE INVENTION

An apparatus for wrapping a stack of objects with a film has according to the invention respective first and second supplies of first and second films and a pull-down device shiftable vertically along the stack of objects. A film-feed head between the pull-down device and the supplies has a drive roller rotatable about an axis fixed in the film feed head and first and second pairs of counterrollers angularly offset from each other relative to the drive-roller axis. The drive roller and the pairs of counterrollers are relatively shiftable between end positions in each of which one of the pairs is spaced from the drive roller and the other pair is engaged with the drive roller. The first film passes between the first pair and the drive roller and the second film passes between the second pair and the drive roller. An actuator can alternately shift the first and the second pairs of rollers relative the drive roller for pinching the films against the drive roller and, on rotation of the drive roller, feeding the pinched film to the pull-down device.

According to a preferred embodiment of the invention, the drive roller is stationary, and either the first pair of counterrollers or the second pair of counterrollers may be moved into engagement with the drive roller by pivoting toward or approaching the drive roller. If the first pair of counterrollers is in contact with the drive roller, the first film is pinched between the first counterrollers and the drive roller and is in contact with the outer surface of the drive roller over a portion of the outer surface of the drive roller. If the second pair of counterrollers is in contact with the drive roller, the second film is pinched between the second counterrollers and the drive roller and is in contact with the outer surface of the drive roller over a portion of its outer surface. In particular in the case of a driven drive roller, either the first film or the second film may be fed to the stack of objects to be sheathed in this way.

According to a preferred embodiment, the counterrollers of the first pair and the second pair of counterrollers are not driven and only the drive roller is driven. Essentially, however, the counterrollers of the first pair and/or of the second pair may also be driven in addition to the drive roller. According to one embodiment, only the counterrollers of the first pair and/or the second pair may be driven, and the drive roller is then not driven. To this extent in this embodiment variant, the term "drive roller" does not mean that the roller need be actively driven. It is also possible that only one counterroller of the first pair and/or of the second pair of counterrollers is driven in the embodiments explained above. The assembly comprising the drive roller, the first pair of counterrollers and the second pair of counterrollers is also referred to briefly below as the film drive mechanism. It is also within the scope of the invention that the lengths of the drive roller and the counterrollers correspond at least to the width of the film fed and are preferably greater than the width of the film being fed. The length of the drive roller and the lengths of the counterrollers refer to their dimensions parallel to their axes of rotation.

It is within the scope of the invention that the first film and the second film are different films that differ in particular with respect to their film format (film dimensions) and/or their film thickness and/or their film material. According to an especially preferred embodiment of the invention, the first film and/or the second film can be fed as a film tube. The first film supply and/or the second film supply is/are then a first and/or second film tube supply. In feeding a film tube, two layers of the film tube, one above the other, are introduced into the film drive mechanism. In feeding a first film tube, two layers of the first film tube lying directly one above the other pass between the first pair of counterrollers and the drive roller. Likewise, feeding a second film tube, two layers of the second film tube layered directly one above the other pass between the second pair of counterrollers and the drive roller. According to a preferred embodiment of the invention, the first and/or second film tube is/are embodied as a side-fold tube. Such a film tube has a fold on each side in a known manner in addition to the two above-described layers one above the other. A recommended embodiment is characterized in that film tube is drawn over the stack of objects to cover the stack as a film hood, and then the film tube is sealed in a manner to be explained further below.

It is within the scope of the invention that the film feed head is above the stack of objects when feeding the film and/or the film tube. The film feed head advantageously has a film cutter for cutting a first film section from the first film or for cutting a second film section from the second film. This film cutter is downstream in the film-travel direction from the film drive unit of the drive roller and counterrollers. A single film cutter is advantageously provided for cutting first film sections from the first film as well as cutting second film sections from the second film. A first or second film section cut by the film cutter is then drawn over the stack of objects. It is within the scope of the invention that the film drive mechanism is above the film cutter. The film cutter is advantageously embodied as a film cutting blade.

According to an especially preferred embodiment of the invention, the film feed head has a film sealer that can seal one end of a film section so that a hood-shaped film section, i.e. a film hood is formed. The film sealer is advantageously downstream in the film-travel direction from the film drive mechanism that consists of a drive roller and the two pairs of counterrollers. It is advisable that only one film sealer is provided for sealing one end of a first film section and also for sealing one end of a second film section. According a preferred embodiment, the film sealer consists of two sealing bars that can be moved toward one another. The film drive mechanism is preferably arranged above the film sealer, and the film cutter is preferably arranged between the film drive mechanism and the film sealer. It is also within the scope of the invention that an opener is provided for opening the film tube before drawing the film tube over the stack of objects. This opener is advantageously designed as a suction opener.

It is also within the scope of the invention that the first pair of counterrollers is on one side of the drive roller, and the second pair of counterrollers is on the opposite side of the drive roller. The counterrollers of the first pair and/or the counterrollers of the second pair are advantageously one after the other and/or above one another in the film-travel direction. According to an especially preferred embodiment of the invention, the two counterrollers of the first pair of counterrollers and/or the two counterrollers of the second pair of counterrollers are spaced vertically and/or essentially vertically, one above the other. A vertical arrangement means in particular that a vertical line runs through the two axes of rotation of the first pair of counterrollers and/or through the two axes of rotation of the second pair of counterrollers. The vertical spacing of the first two counterrollers and/or the second two counterrollers advantageously occurs both when they are in contact with the drive roller and when they are out of engagement with the drive roller.

The axis of rotation of the upper counterroller of the first pair of counterrollers and/or the axis of rotation of the upper counterroller of the second pair of counterrollers is/are preferably above the axis of rotation of the drive roller. The axis of rotation of a lower counterroller of the first pair of counterrollers and/or the axis of rotation of a lower counterroller of the second pair of counterrollers is advantageously below the axis of rotation of the drive roller. As recommended, the axis of rotation of the upper counterroller of the first pair of counterrollers is at the same height as the axis of rotation of the upper counterroller of the second pair of counterrollers. The same height here means in particular that a horizontal line runs through the axes of rotation of the two counterrollers. The axis of rotation of the lower counterroller of the first pair of counterrollers is advantageously at the same height as the height of the axis of rotation of the lower counterroller of the second pair of counterrollers. An especially preferred embodiment of the invention is characterized in that the angle $\alpha$ between a straight line through the axis of rotation of the drive roller and through the axis of rotation of a counterroller in contact with the drive roller and a horizontal line amounts to 30° to 55°, preferably 35° to 50°. The above-described condition advantageously applies to all four counterrollers when they are each in contact with the drive roller. The above-described angle $\alpha$ is preferably 37° to 41° and/or approximately 40°. If it is mentioned above and/or below that a counterroller and/or counterrollers are in contact with the drive roller, this means that the film for the feed and/or the respective film tube for the feed is/are always pinched between the counterroller and the drive roller.

It is within the scope of the invention that the diameter of the drive roller is larger than the diameter of the counterrollers. It is self-evident that the diameter is measured at a right angle to the axis of rotation of the drive roller and/or at a right angle to the axis of rotation of a counterroller. The diameter of the drive roller is advantageously at least 1.5 times, preferably at least 1.7 times greater than the diameter of the counterrollers. Preferably all the counterrollers have the same diameter.

According to a very preferred embodiment of the invention, the outer surface of the drive roller is made of an elastomer. The outer surface of the drive roller is in contact with the film and/or with the film tube in the feed, i.e. conveyance of a film or film tube. It is recommended that the film be wrapped around at least 16%, preferably at least 18% and especially at least 20% of the outer surface of the drive roller in feeding the first or second film with the first or second pair of counterrollers in contact with the drive roller.

The first film and the second film are advantageously fed to the film drive mechanism from the same side of the apparatus. The first film is preferably fed underneath the second film of the film drive mechanism. It is advisable for the first film supply and the second film supply to be on the same side of the apparatus. The first and second film supplies are preferably one above the other.

The subject of the invention is also a method of wrapping a stack of objects with a film, such that optionally a first film or a second film is supplied from a film feed head, the film feed head having a drive roller, a first pair of counterrollers and a second pair of counterrollers, and such that either the first pair of counterrollers is engaged with the drive roller to pinch the first film and the drive roller is driven to feed the first film, or the second pair of counterrollers is engaged with the drive roller with the second film pinched between and the drive roller is driven to feed the second film.

The present invention is based on the discovery that with the inventive apparatus and/or the inventive method, a simple, less complex and at the same time reliably functioning change between the feed of the first type of film and a second type of film is possible. The change between the two types of film may be made surprisingly promptly in particular. The two types of film may be films of different formats or film types of different material. The invention has proven successful in particular in feeding a film tube. The invention is also based on the finding that through the inventive embodiment of the apparatus, the film is much more easily processed by machine in comparison with known apparatuses. It should also be emphasized that the inventive apparatus has a relatively simple and/or less complex design and can be implemented at a relatively low is manufacturing cost.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
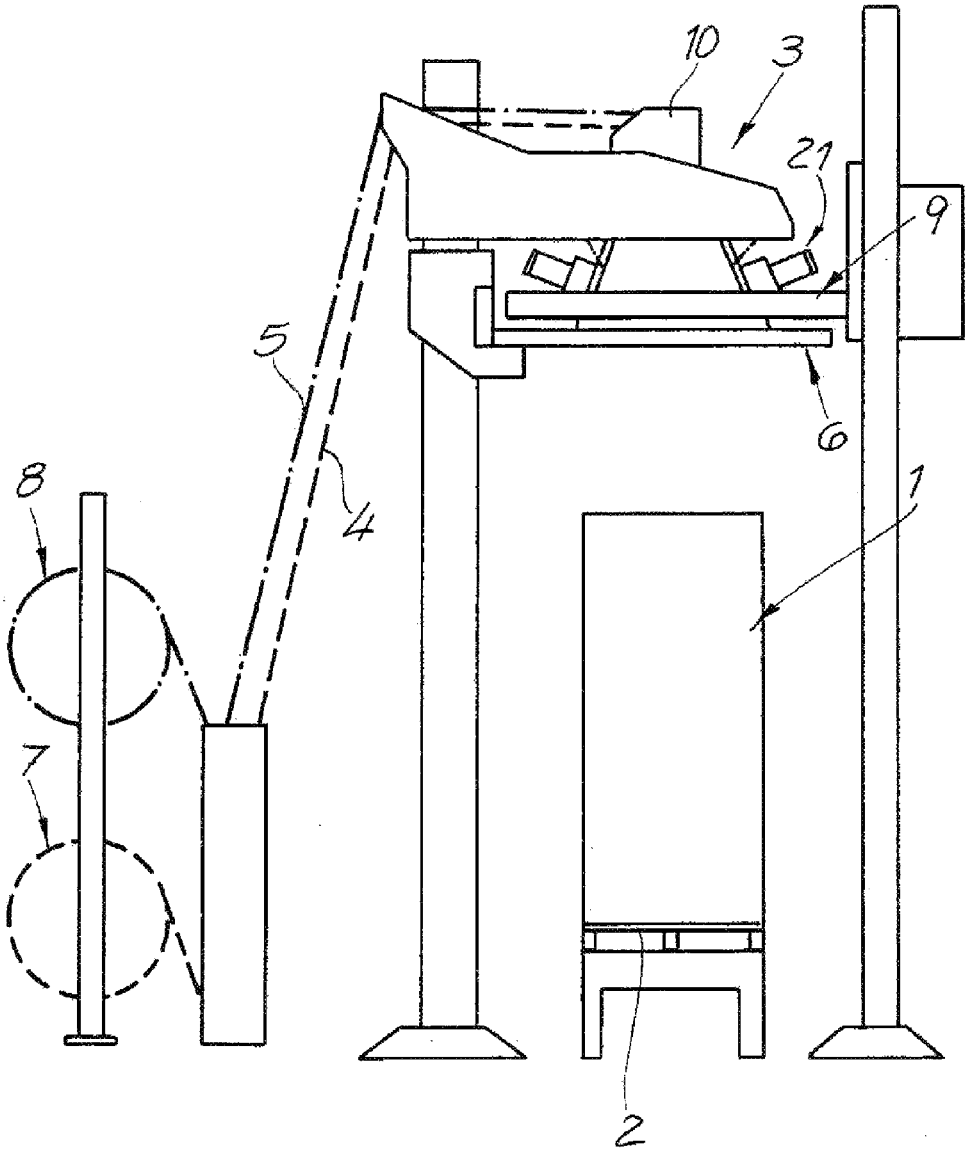
FIG. 1 is a schematic side view of an inventive apparatus.

As seen in FIG. 1 an apparatus according to the invention serves for wrapping a stack 1 of objects with a film 4 or 5. In the illustrated embodiment, the stack 1 of objects is supported on a pallet 2. The apparatus has a film feed head 3 for optional feed of the first film 4 or the second film 5. Furthermore, the apparatus is equipped with a drawing mechanism 6 for pulling the first film 4 or the second film 5 over the object stack 1. In addition, a first film supply 7 in the form of a roll of the first film 4 and a second film supply 8 in the form of a roll of the second film 5 are provided.

Preferably and in the illustrated embodiment, the first film 4 and the second film 5 are both fed as a film tube. For drawing the film over the stack of objects, a film tube section is cut off the first film tube or the second film tube and advantageously drawn over the stack of objects as a film hood that is not described further.

FIG. 1 also shows a shrink frame 9 for shrinking the film 4 or 5 onto the object stack 1. The invention may be used advantageously for such shrink-film apparatuses. However, it may likewise be used advantageously in hood-stretching systems, for example.

Figure 2:
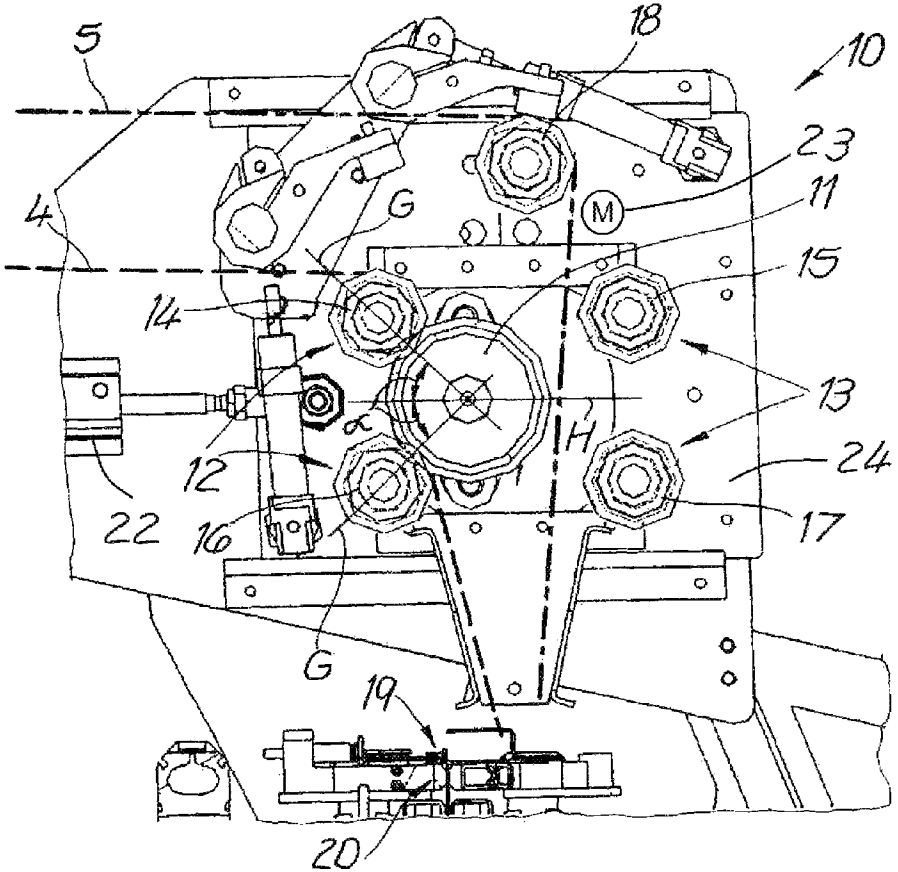
FIG. 2 is an enlarged view of the detail indicated at II in FIG. 1.
Figure 3:
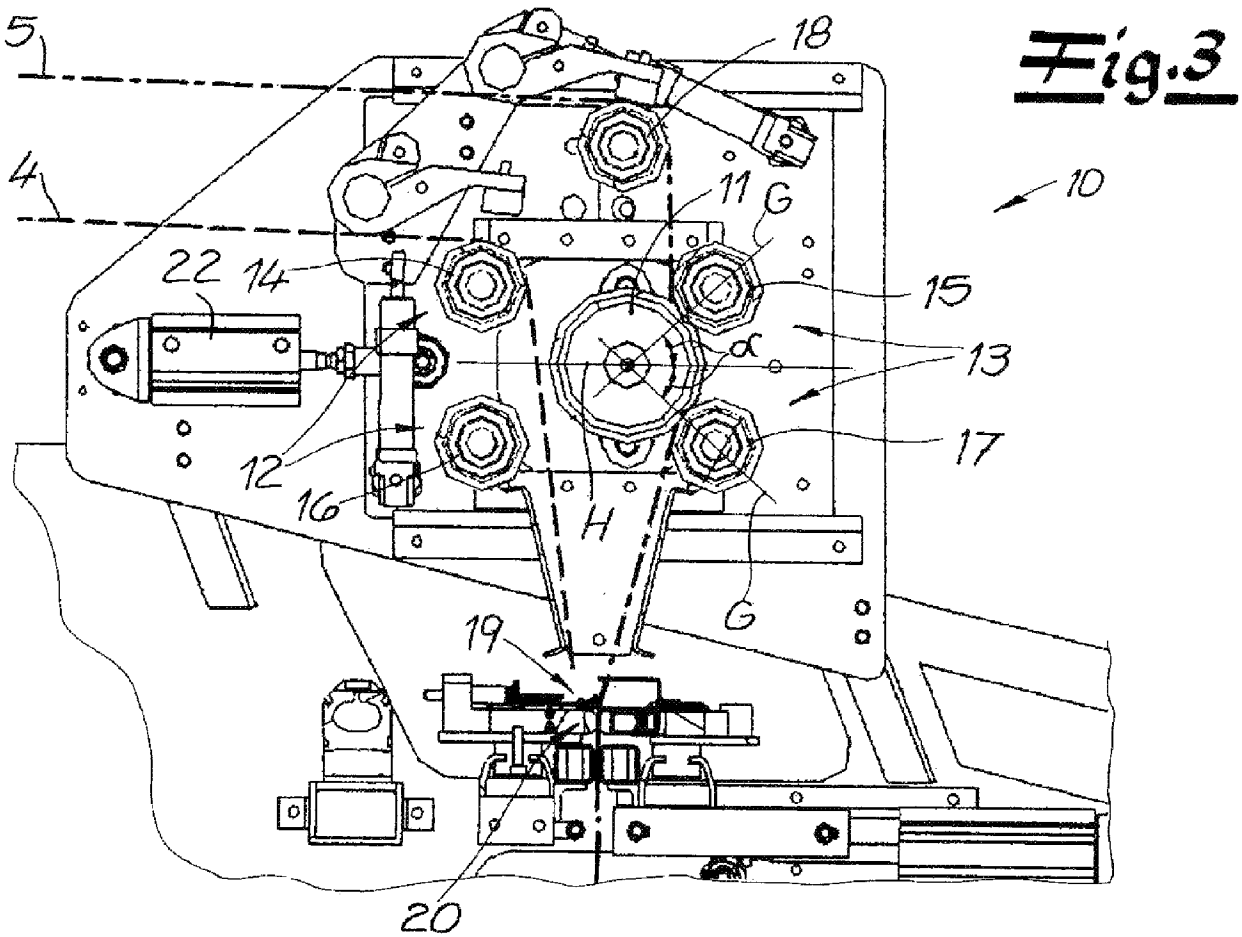
FIG. 3 shows the apparatus as in FIG. 2 but in another position.

FIGS. 2 and 3 show in detail a film drive mechanism 10 of the film feed head 3 for feeding a first film 4 or a second film 5 in particular. The film drive mechanism 10 has a driven drive roller 11, a first pair 12 of two counterrollers 14, 16 and a second pair 13 of two counterrollers 15, 17. Preferably and in the illustrated embodiment according to FIGS. 2 and 3, the drive roller 11 is stationary, and the first pair 12 of counterrollers 14 and 16 or the second pair 13 of counterrollers 15 and 17 may be engaged with the drive roller 11. The first film 4 passes between the drive roller 11 and the first pair 12 of counterrollers 14 and 16 in contact with the latter (FIG. 2). Accordingly, with the second pair 13 of counterrollers 15 and 17 in contact with the drive roller 11, the second film 5 passes between the drive roller 11 and the second pair of counterrollers 13 (FIG. 3). FIG. 2 shows the position with the film drive mechanism 10 feeding the first film 4, and FIG. 3 shows the position with the film drive mechanism 10 feeding the second film 5. Preferably and in the illustrated embodiment, only the drive roller 11 is driven for feeding film 4 or 5, and neither the first pair 12 of counterrollers 14 and 16 nor the second pair 13 of counterrollers 15 and 17 is driven.

FIGS. 2 and 3 show that according to the preferred embodiment, the first pair 12 of counterrollers 14 and 16 is mounted on one side of the drive roller 11, and the second pair 13 of counterrollers 15 and 17 is on the opposite side of the drive roller 11. Preferably and in the illustrated embodiment, the two counterrollers 14 and 16 of the first pair 12 of counterrollers 14 and 16 and the two counterrollers 15 and 17 of the second pair 13 of counterrollers 15 and 17 are mounted vertically one above the other. As shown in FIGS. 2 and 3, this applies preferably and in the illustrated embodiment, both when the counterrollers are in contact with the drive roller 11 and when the counterrollers 14, 15, 16, 17 are not in contact. Advantageously and in the illustrated embodiment, the axis of rotation of the upper counterroller 14 of the first pair 12 of counterrollers 14 and 16 and the axis of rotation of the upper counterroller 15 of the second pair 13 of counterrollers 15 and 17 are above the axis of rotation of the drive roller 11. Preferably and in the illustrated embodiment, the axis of rotation of the lower counterroller 16 of the first pair 12 of counterrollers 14 and 16 and the axis of rotation of the lower counterroller 17 of the second pair 13 of counterrollers 15 and 17 are below the axis of rotation of the drive roller 11. Preferably and in the illustrated embodiment, an angle $\alpha$ between a straight line G through the axis of rotation of the drive roller 11 and through the axis of rotation of one of the counterrollers 14, 15, 16, 17 in contact with the drive roller 11 and a horizontal line H is 39° or approximately 39°.

Preferably and in the illustrated embodiment, the diameter of the drive roller 11 is larger than the diameter of the counterrollers 14, 15, 16, 17. In the illustrated embodiment, the diameter of the drive roller 11 is approximately twice as great as the diameter of the counterrollers 14, 15, 16, 17. Preferably and in the illustrated embodiment, the drive roller 11 is a rubber roller or a drive roller 11 having an outer surface made of an elastomer. The film 4 or 5 is in contact with this outer surface when being fed. Preferably and in the illustrated embodiment, the film 4 or 5 is wrapped around at least 18% of the outer surface of the drive roller 11 feeding the first or the second film 4 or 5 with the respective first or second pair 12, 13 of counterrollers 14, 15, 16, 17 in contact with the driven drive roller 11.

FIGS. 2 and 3 also show that the first film 4 and the second film 5 are fed from the same side as the film drive mechanism 10. The first film 4 in the illustrated embodiment is fed underneath the second film 5. The second film 5 is fed over a guide roller 18 by the film drive mechanism 10 in the illustrated embodiment. FIG. 1 shows that the first film supply 7 and the second film supply 8 are also on the same side of the inventive apparatus, and in FIG. 1 they are one above the other. The rollers 14, 15, 16, 17, and 18 are all mounted on a plate 24 that can be slid by an actuator 22 between the FIG. 2 position with the counterrollers 14 and 16 pinching the film 14 against the roller 11 and the position of FIG. 3 with the rollers 15 and 17 pinching the film 5 against the roller 11. In an unillustrated intermediate position of the plate 24, neither of the films 4 or 5 is pressed against the roller 11. A motor 23 normally keeps the roller 11 in constant rotation.

The figures also show that the film feed head 3 has a film cutter in the form of a film cutting blade 19 with which a first section can be cut from the first film 4 or a second section can be cut from the second film 5. This film cutter and/or the film cutting blade 19 is/are arranged below the film drive mechanism in the illustrated embodiment. Furthermore, the film feed head 3 has a film sealer in the form of two sealing bars 20. One end of a film section from the first film 4 or from the second film 5 can be sealed using this film sealer and/or the sealing bar 20, to produce a hood-shaped film section, i.e. a film hood is formed. This hood-shaped film section, i.e. this film hood, is then drawn over the object stack 1.

In the illustrated embodiment, the sealing bars 20 are arranged below the film drive mechanism 10 and also below the film cutting blade 19. In the illustrated embodiment, the inventive apparatus also advantageously has an opener 21 that is not shown in detail here, for opening a film tube. This may be a suction opener in a known way.

I claim:

1. An apparatus for wrapping a stack of objects with a film, the apparatus comprising:

respective first and second supplies of first and second films;

a pull-down device shiftable vertically along the stack of objects; and a film-feed head between the pull-down device and the supplies and having:

a drive roller rotatable about an axis in the film feed head, first and second pairs of counterrollers angularly offset from each other relative to the drive-roller axis, the drive roller and the pairs of counterrollers being relatively shiftable between end positions in each of which one of the pairs is spaced from the drive roller and the other pair is engaged with the drive roller, the first film passing between the first pair and the drive roller and the second film passing between the second pair and the drive roller, and actuator means for alternately relatively shifting the first and the second pairs of rollers relative the drive roller for pinching the films against the drive roller and, on rotation of the drive roller, feeding the pinched film to the pull-down device.

2. The wrapping apparatus defined in claim 1 wherein each of the films is a tube, the apparatus further comprising:

means for spreading the tube in the pull-down device for fitting it down over the stack of objects.

3. The wrapping apparatus defined in claim 2, further comprising:

means for sealing together the tube above the stack of objects after pulling the tube down over the stack of objects.

4. The wrapping apparatus defined in claim 1, further comprising:

means for cutting a leading end off the film after the pull-down device fits the leading end to the stack.

5. The wrapping apparatus defined in claim 1 wherein the pairs of counterrollers generally diametrally horizontally flank the drive roller.

6. The wrapping apparatus defined in claim 5 wherein each pair of counterrollers includes a lower counterroller and vertically thereabove a respective upper counterroller.

7. The wrapping apparatus defined in claim 6 wherein the drive-roller axis is horizontal and the counterrollers are rotatable about respective horizontal axes, the axes of the upper counterroller being above the drive-roller axis.

8. The wrapping apparatus defined in claim 7 wherein the axes of the lower counterrollers are below the drive-roller axis.

9. The wrapping apparatus defined in claim 8 wherein an angle between a straight line through the drive-roller axis and through the axis of rotation of any of the counterrollers when in contact with the drive roller and a horizontal line is equal to 30° to 55°.

10. The wrapping apparatus defined in claim 9 wherein the angle is 35° to 50°.

11. The wrapping apparatus defined in claim 9 wherein the angle is 37° to 41°.

12. The wrapping apparatus defined in claim 1 wherein a diameter of the drive roller is greater than a diameter of any of the counterrollers.

13. The wrapping apparatus defined in claim 12 wherein the diameter of the drive roller is at least 1.5 times greater than the diameter of any of the counterrollers.

14. The wrapping apparatus defined in claim 1 wherein the drive roller has an outer surface of an elastomer.

15. The wrapping apparatus defined in claim 1 wherein when one of the films is pinched by the respective counterrollers against the drive roller, the pinched film engages the drive roller over an angle of at least 18% relative to a rotation axis of the drive roller.

16. The wrapping apparatus defined in claim 1 wherein both of the film supplies are horizontally to one side of the head and device and one of the films moves horizontally above the other of the films to the feed head.

17. A method of wrapping a stack of objects with either of two different first and second films, the method comprising the steps of:

feeding the first and second films from respective supplies through a film-feed head to a pull-down device;

providing the film feed head with:

a drive roller rotatable about an axis fixed in the film feed head, and first and second pairs of counterrollers angularly offset from each other relative to the drive-roller axis and each shiftable radially toward and away from the drive roller;

passing the first film between the first pair and the drive roller and the second film passing between the second pair and the drive roller;

alternately shifting the pairs of counterrollers radially toward and away from the drive roller for pinching the respective film against the drive roller and, on rotation of the drive roller, feeding the pinched film to the pull-down device; and pulling the pinched film with the device down over the stack.

* * * * *